United States Patent [19]

Brunn

[11] Patent Number: 4,700,106

[45] Date of Patent: Oct. 13, 1987

[54] COLOR PICTURE TUBE DEFLECTION UNIT

[75] Inventor: Otto Brunn, Wernau, Fed. Rep. of Germany

[73] Assignee: Alcatel N.V., Amsterdam, Netherlands

[21] Appl. No.: 711,957

[22] Filed: Mar. 14, 1985

[30] Foreign Application Priority Data

Mar. 17, 1984 [DE] Fed. Rep. of Germany ..... 3409919

[51] Int. Cl.[4] ..... H01J 29/48; H01J 29/70

[52] U.S. Cl. ..... 313/413; 313/425; 313/446

[58] Field of Search ..... 313/409, 413, 431, 440, 313/446, 412, 414, 421, 425, 430, 442, 443

[56] References Cited

U.S. PATENT DOCUMENTS 3,196,305 7/1965 Barkow ..... 313/413

FOREIGN PATENT DOCUMENTS 1242957 8/1971 United Kingdom ..... 313/413

*Primary Examiner*—David K. Moore
*Assistant Examiner*—K. Wieder
*Attorney, Agent, or Firm*—Peter C. Van Der Sluys

[57] ABSTRACT

A color picture tube comprises electron guns disposed in the corners of a triangle, a slit-type shadow mask and a phosphor screen consisting of vertical phosphor stripes. In the electron-gun system and/or on the side thereof facing the deflection unit, or between the electron-gun system and the deflection unit, there is provided an additional magnetic deflector. This deflector serves to deflect the electron beams such that, within the range of action of the deflection unit, they extend in a horizontal common plane passing through the tube axis.

7 Claims, 7 Drawing Figures

COLOR PICTURE TUBE DEFLECTION UNIT

BACKGROUND OF THE INVENTION

This invention relates to a color picture tube. More specifically, the invention pertains to a color picture tube having a faceplate with a deposited phosphor screen, a shadow mask in front of the phosphor screen, a cone with a bulb neck portion on which a deflection unit is disposed and in which a three electron-gun system is disposed.

Such a color picture tube is known from German OS No. 2,621,389. Color picture tubes in which the electron guns are disposed in a triangular configuration are referred to as delta tubes, and are featured by good electron-optical properties.

The electron guns can also be disposed in a plane extending through the tube axis. These color picture tubes are deferred to as in-line tubes, and permit a simplified convergence adjustment.

SUMMARY OF THE INVENTION

It is one object of the invention to provide a color picture tube comprising electron guns disposed in a triangular configuration, which also permits simple convergence adjustment.

In accordance with the invention a color picture tube comprises electron guns disposed in a triangular configuration, a slit-type shadow mask and a phosphor screen consisting of vertical phosphor stripes. In the electron-gun system and/or on the side thereof facing the deflection unit, or between the electron gun system and the deflection unit, there is provided an additional magnetic deflector. This deflector serves to deflect the electron beams within the range of action of the deflection unit such that the beams extend in a horizontal common plane passing through the tube axis.

A color picture tube in accordance with the invention has good electron-optical properties due to the arrangement of the electron-gun system in a triangle, and permits simple convergence adjustment due to the electron beams extending in a plane through the tube axis, within the deflection center. Moreover, the adjustment of the color selection angle becomes simpler.

BRIEF DESCRIPTION OF THE DRAWINGS

The invention will be better understood from a reading of the following detailed description in conjunction with the drawings, in which.

DETAILED DESCRIPTION

Figure 1:
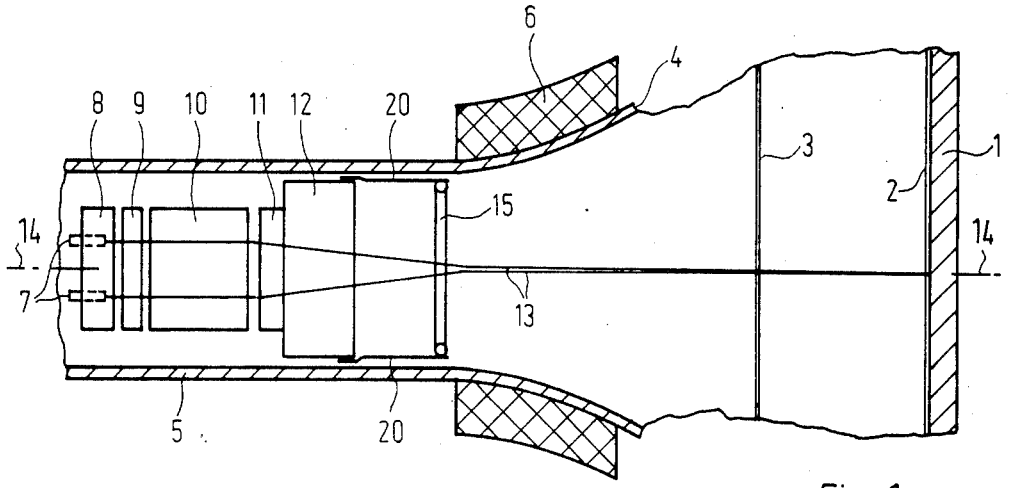
FIG. 1 is a sectional view taken along the vertical axis of a portion of a color picture tube.

In FIG. 1, only part of a color picture tube is shown in a sectional representation for clarity. This section was taken along the vertical axis of the color picture tube. The color picture tube includes a faceplate 1 with a phosphor screen 2 deposited on the inside surface thereof, a shadow mask 3 disposed in front of the screen, and a bulb 4 which extends into the neck portion 5. Deflection unit 6 is mounted on the neck portion 5. The electron-gun system is mounted inside the neck portion 5. At the end of the neck portion 5 there is provided a base which is not shown.

The electron-gun system comprises three electron guns, the three cathodes 7 of which are disposed in a triangular configuration, as for example, in the corners of an isosceles triangle. One lateral side of the triangle extends parallel in relation to the horizontal axis of the color picture tube. The cathodes 7 are surrounded by control electrodes 8, i.e., Wehnelt cylinders. A screen grid 9, focusing electrodes 10 and anodes 11 are positioned in neck portion 5 and are followed by a convergence cup 12. This electron-gun system structure may consist of individual electron guns or may be an integrated system. It is advantageous for individual electrodes of the system to be designed to fit telescopically into one another. The usual glass rods for holding the electron-gun system inside the neck part 5 are not shown.

The number of electrodes in each of the electron guns is not restricted to four.

The electron beams produced by the electron-gun system are indicated by the reference numeral 13. Only the left-hand and the right-hand ends are shown of the tube axis 14 which represents the axis of symmetry of the color picture tube.

The phosphor screen 2 consists of vertical stripes of alternately red, green, and blue emitting phosphors of the kind customarily used with in-line tubes. Shadow mask 3 is a slit-type shadow mask.

A magnetic deflector which produces a static magnetic field is mounted to the convergence cup 12, with the aid of braces 20. The deflector includes of a multipolar magnetic ring 15. This multipolar magnetic ring 15 is disposed between the convergence cup 12 and the deflection unit 6. Electron beams 13 are first deflected electrostatically by the focusing electrodes 11 in the direction of the tube axis 14. Thereafter, the electron beams 13 are deflected by the magnetic field of the multipolar magnetic ring 15 in such a way as to extend in a common horizontal plane containing the tube axis 14. The corresponding, idealized path of the electron beams 13 is shown in FIG. 1. In their further path, the electron beams 13 can be deflected in the way known from the in-line technique.

Figure 2:
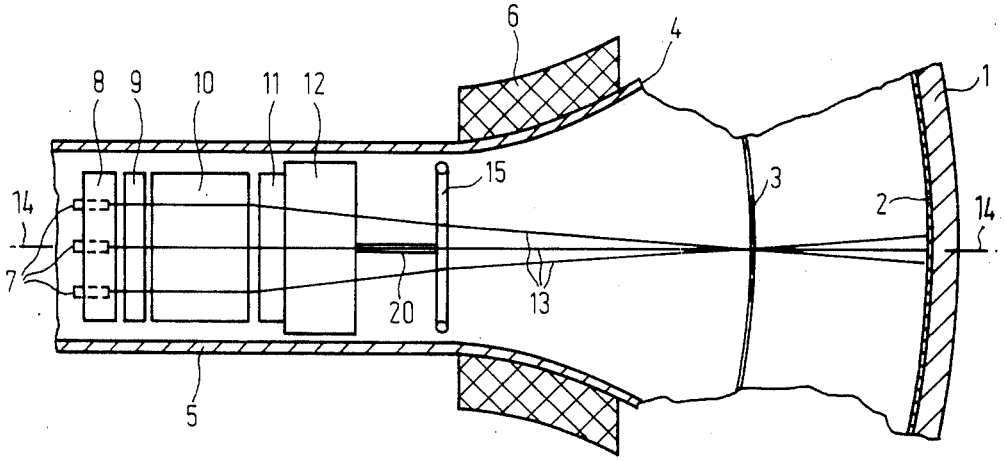
FIG. 2 is a sectional view taken along the horizontal axis of the color picture tube of FIG. 1.

FIG. 2 shows the color picture tube in a section taken along the horizontal axis, with identical parts being indicated by the same reference numerals. The path of the electron beams 13 are shown. Likewise, it can be seen that the color selection angle of the two outer electron beams is influenced by the multipolar magnetic ring 15.

Figure 3:
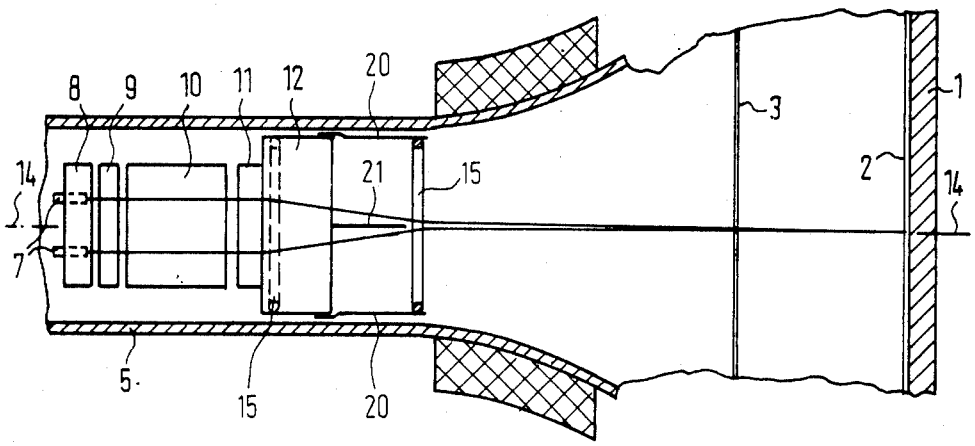
FIG. 3 is a sectional view taken along the vertical axis of the color picture tube of FIG. 1, having a modified type of deflector.

FIG. 3 shows the color picture tube of FIG. 1 with a different type of magnetic deflector. This type of magnetic deflector consists of two multipolar magnetic rings 15 disposed at a spacing behind each other. The one multipolar magnetic ring 15 is disposed inside the convergence cup 12 and the other multipolar magnetic ring 15 is mounted, via braces 20, to the convergence cup 12 and projects into the space between the convergence cup 12 and the deflection unit 6. Shielding 21 may be provided for on the convergence cup. In this embodiment of the deflector, the electron beams 13 are deflected into a common horizontal plane which contains the tube axis 14 solely by mean of the multipolar magnetic rings 15 without any electrostatic deflection before entering into the range of action of the deflection unit 6.

Figure 4:
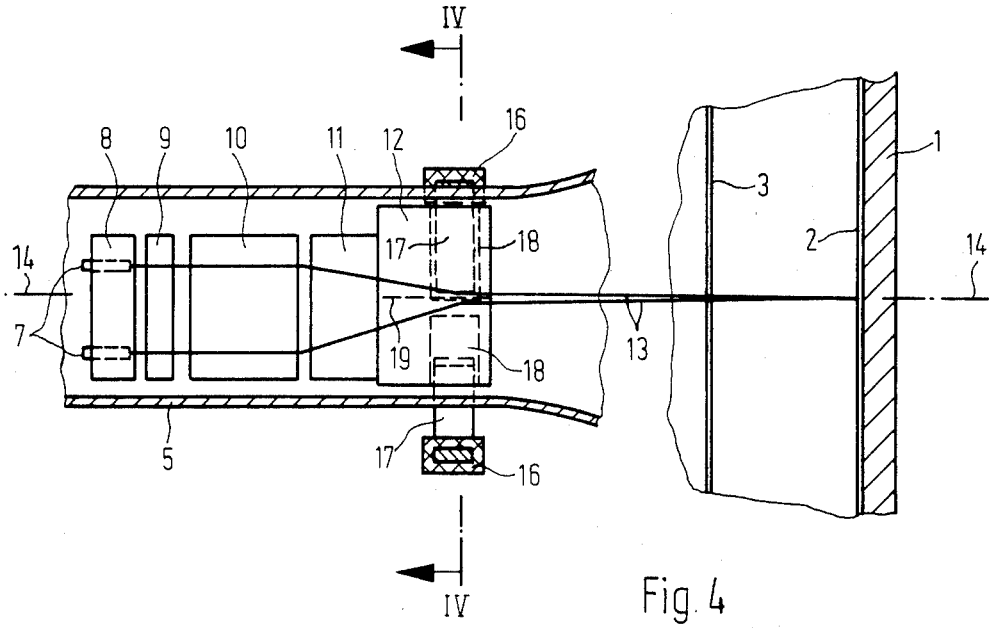
FIG. 4 is the color picture tube of FIG. 1 with a modified type of deflector.

FIG. 4. is a section taken along the vertical axis of the color picture tube of FIG. 1, and identical parts are again indicated by the same reference numerals. Moreover, in this representation; the bulb and the deflection unit are not shown. The electron beams 13 are first electrostatically deflected by focusing electrodes 11 toward the tube axis 14. The magnetic deflector for deflecting the electron beams 13 into the common, horizontal plane which contains the tube axis 14 effects the deflection with the aid of magnetic fields produced in electromagnets 16. Three electromagnets 16 are disposed on the neck portion 5 and the magnetic fields thereof act upon the electron beams 13 via flux guides 17 and pole pieces (shoes) 18 provided for in the neck portion 5 and the convergence cup 12.

Figure 5:
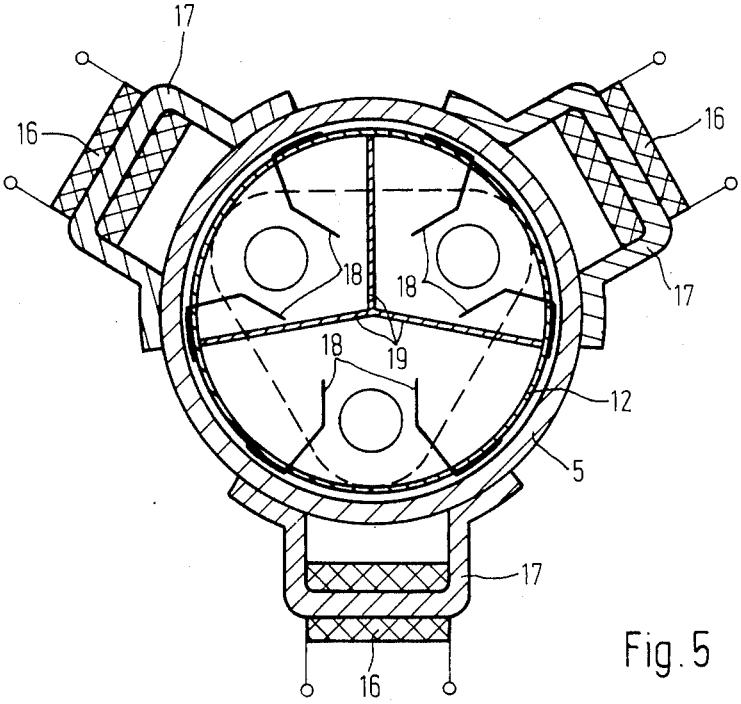
FIG. 5 is a sectional view taken on line IV—IV of FIG. 4.

FIG. 5 is a section taken on line IV—IV of FIG. 4. Here, the three electromagnets 16 with their flux guides 17 and pole pieces 15 are clearly recognizable. The three pole pieces 18 are shielded from one another by magnetically conductive separating walls 19, so that their respective magnetic field only influences the respective associated electron beam.

Figure 6:
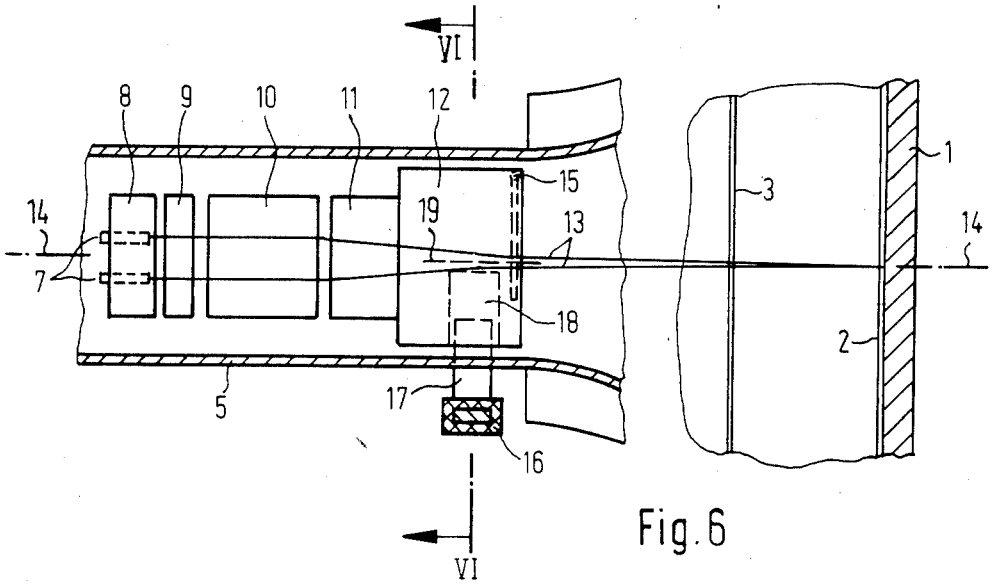
FIG. 6 shows the color picture tube of FIG. 1 with another type of deflector.

FIG. 6, again, shows a section taken on the vertical axis of the color picture tube of FIG. 1. In this representation, the deflection unit and the neck portion are likewise not shown. The magnetic deflector, in this case, consists of the combination of a multipolar magnetic ring 15 and one electromagnet 16. This arrangement is advantageous in cases where the cathodes 7 are disposed in a triangular configuration, such as in the corners of an obtuse-angled, isosceles triangle whose base side extends parallel in relation to the horizontal axis. In this embodiment the first deflection of the electron beams 13, is effected electrostatically by the focusing electrode 11. Thereafter, the deflection of the electron beams extending in the upper part of FIG. 6, is effected by the multipolar magnetic ring 15 which, in this particular case, is designed as a yoke. The lower electron beam is deflected by the field of the electromagnet 16.

Figure 7:
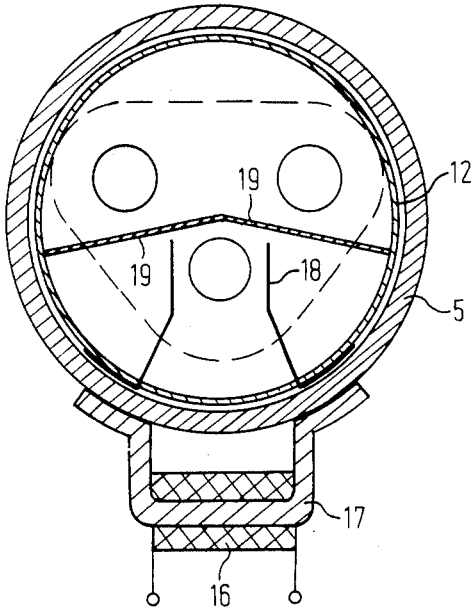
FIG. 7 is a sectional view taken on line VI—VI of FIG. 6.

FIG. 7 is a sectional view taken on line VI—VI of FIG. 6. The magnetic field of the electromagnet 16, via the pole pieces 18, only acts upon the electron beam coming from the cathode disposed in the corner opposite the base side of the triangle. The effect of the electromagnet 16 is restricted to this particular electron beam due to magnetically shielding partition wall 19. The electron beams from the other two cathodes are deflected by the multipolar magnetic ring 15.

What is claimed is:

1. A color picture tube comprising:

a faceplate with a deposited phosphor screen of phosphor stripes;

a shadow mask disposed in front of said screen;

a cone with a bulb neck portion;

a deflection unit on said neck portion;

an electron-gun system disposed in said neck portion, said electron-gun system including three electron guns disposed in a delta configuration; and a magnetic deflector disposed between said electron-gun system and said deflection unit for defllecting electron beams from said electron guns into a common horizontal plane extending through the tube axis, said deflector including at least one multipolar magnetic ring pointing toward said deflection unit.

2. A color picture tube in accordance with claim 1, wherein:

said multipolar magnetic ring is disposed between said electron-gun system and said deflection unit.

3. A color picture tube in accordance with claim 1, comprising:

first and second multipolar magnetic rings disposed one behind the other, said first multipolar magnetic ring disposed in a convergence cup, and said second multipolar magnetic ring disposed between said electron-gun system and said deflection unit.

4. A color picture tube in accordance with claim 1, wherein:

said magnetic deflector further includes at lease one electromagnet.

5. A color picture tube in accordance with claim 4, wherein:

said electromagnet is disposed outside said bulb neck portion and comprises pole shoes inside a convergence cup.

6. A color picture tube in accordance with claim 1, wherein:

said delta configuration corresponds to an obtuse-angled, isosceles triangle;

wherein said multipolar magnetic ring is arranged for displacing electron beams of said electron guns disposed in the corners of the base side of said triangle; and wherein said deflector further includes an electromagnet disposed on said neck portion for displacing the electron beam of the third electron gun.

7. A color picture tube in accordance with claim 6, wherein:

said multipolar magnetic ring and the pole shoes of said electromagnet are disposed inside a convergence cup.

* * * * *